US007736832B2

(12) United States Patent
Farrugia et al.

(10) Patent No.: US 7,736,832 B2
(45) Date of Patent: Jun. 15, 2010

(54) TONER COMPOSITIONS

(75) Inventors: Valerie M. Farrugia, Oakville (CA); Michael S. Hawkins, Cambridge (CA); Rosa M. Duque, Brampton (CA); Britawit Asfaw, Oakville (CA); Richard P. N. Veregin, Mississauga (CA); Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 765 days.

(21) Appl. No.: 11/668,178

(22) Filed: Jan. 29, 2007

(65) Prior Publication Data

US 2008/0182192 A1 Jul. 31, 2008

(51) Int. Cl.
*G03G 9/08* (2006.01)

(52) U.S. Cl. ..... 430/137.14

(58) Field of Classification Search ..... 430/137.14
See application file for complete search history.

(56) References Cited

U.S. PATENT DOCUMENTS

| | | | | |
|---|---|---|---|---|
| 5,166,026 | A | 11/1992 | Fuller et al. | |
| 5,290,654 | A | 3/1994 | Sacripante et al. | |
| 5,308,734 | A | 5/1994 | Sacripante et al. | |
| 5,370,963 | A | 12/1994 | Patel et al. | |
| 5,593,807 | A | 1/1997 | Sacripante et al. | |
| 6,413,691 | B2 | 7/2002 | Daimon et al. | |
| 6,830,860 | B2 | 12/2004 | Sacripante et al. | |
| 7,029,817 | B2 | 4/2006 | Robinson et al. | |
| 2008/0090163 | A1 * | 4/2008 | Agur et al. | 430/137.14 |
| 2008/0153027 | A1 * | 6/2008 | Veregin et al. | 430/137.14 |
| 2008/0182193 | A1 * | 7/2008 | Agur et al. | 430/137.14 |

FOREIGN PATENT DOCUMENTS

| | | | |
|---|---|---|---|
| EP | 1 441 260 | A1 | 7/2004 |
| EP | 1 550 915 | A1 | 7/2005 |
| EP | 1 795 971 | A | 6/2007 |
| JP | 2006-113473 | | 4/2006 |

OTHER PUBLICATIONS

U.S. Appl. No. 11/094,413, filed Mar. 31, 2005 to Szabo et al.

* cited by examiner

*Primary Examiner*—Christopher RoDee
(74) *Attorney, Agent, or Firm*—Oliff & Berridge, PLC

(57) ABSTRACT

Toners made by the emulsion aggregation process comprising an amorphous resin and a nucleated crystalline resin. Such toners demonstrate improved charging performance in the A-zone and the C-zone, improved heat cohesion and improved resistivity.

17 Claims, No Drawings

TONER COMPOSITIONS

BACKGROUND

Disclosed herein is an emulsion aggregation toner comprising an amorphous resin and a nucleated crystalline resin. The toners disclosed herein demonstrate improved charging in the A-zone and C-zone, improved heat cohesion and improved resistivity.

REFERENCES

Low fixing toners comprised of semicrystalline resins are known, such as those disclosed in U.S. Pat. No. 5,166,026. There, toners comprised of a semicrystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed.

Low fixing crystalline based toners are disclosed in U.S. Pat. No. 6,413,691. There, a toner comprised of a binder resin and a colorant, the binder resin containing a crystalline polyester containing a carboxylic acid of two or more valences having a sulfonic acid group as a monomer component, are illustrated.

Ultra low melt toner compositions comprising a branched amorphous resin, a crystalline resin and a colorant are disclosed in U.S. Pat. No. 6,830,860, which is incorporated herein by reference in its entirety.

Current crystalline and semi-crystalline toners and development systems comprising such toners may exhibit lesser performance in higher humidity conditions. It is desirable that developers be functional under all environmental conditions to enable good image quality from a printer. In other words, it is desirable for developers to function at low humidity such as a 15% relative humidity at a temperature of about 12° C. (denoted herein as C-zone) and at high humidity such as at 85% relative humidity at a temperature of about 28° C. (denoted herein as A-zone).

Toner blends containing crystalline or semi-crystalline polyester resins with an amorphous resin have been recently shown to provide very desirable ultra-low melt fusing, which is a key enabler for high-speed printing and for lower fuser power consumption. These types of toners containing crystalline polyester have been demonstrated in both emulsion aggregation (EA) toners, and in conventional jetted toners. Improvement of toners containing crystalline or semi-crystalline polyester resins is still desired, for example with respect to charge performance in the A-zone.

Thus, toners that exhibit good charging in both A-zone and C-zone, improved heat cohesion and improved resistivity in the A-zone are still desired.

SUMMARY

In embodiments, disclosed herein is a toner composition including toner particles comprising a nucleated crystalline resin and an amorphous resin.

In further embodiments, disclosed herein is a process comprising forming a nucleated crystalline resin emulsion comprising a crystalline resin and a nucleating agent, forming an amorphous resin emulsion comprising an amorphous resin, combining the nucleated crystalline resin emulsion and the amorphous resin emulsion to form a pre-toner mixture, and aggregating and coalescing the pre-toner mixture to form toner particles.

In yet further embodiments, disclosed herein is an electrophotographic image forming apparatus comprising a photoreceptor, a development system, and a housing in association with the development system for a developer comprising a toner having a nucleated crystalline polyester resin and an amorphous resin, wherein the toner has a charge distribution in A-zone and C-zone from about −2 mm to about −25 mm displacement, wherein the toner has a resistivity of at least about $1\times10^{12}$ ohm-cm, and wherein the toner has a toner cohesion of from about 1 percent to about 40 percent.

EMBODIMENTS

Described herein are toner compositions having toner particles comprising a nucleated crystalline resin and an amorphous resin. The toners disclosed herein exhibit improved charging in the A-zone and the C-zone, decreased heat cohesion and increased resistivity.

Examples of crystalline polyester resins suitable for use herein include, for example, alkali sulfonated polyester resins. Crystalline resin examples include, but are not limited to, alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfoisophthaloyl)-copoly (pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl)-copoly(propylene-succinate), alkali copoly(5-sulfo-isophthaloyl)-copoly(butylenes-succinate), alkali copoly(5-sulfo-isophthaloyl)-copoly(pentylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(hexylene-adipate), poly(octylene-adipate), and combination thereof, and wherein the alkali is a metal such as sodium, lithium or potassium.

As used herein, "crystalline" refers to a polymer with a three dimensional order. "Semicrystalline" as used herein refers to materials with a crystalline percentage of, for example, from about 10 to about 60 percent, and more specifically from about 12 to about 50 percent. Further, as used hereinafter "crystalline" encompasses both crystalline resins and semicrystalline materials, including saturated and unsaturated crystalline materials, unless otherwise specified.

If semicrystalline polyester resins are employed herein, the semicrystalline resin includes, for example, poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), polyethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarhoxylate), poly(trimethylene dodecane dioate), poly(m-xylene), poly(p-xylylene pimelamide), and combinations thereof. The semicrystalline resins possess, for example, a suitable weight average molecular weight Mw, such as from about 7,000 to about 200,000, and more specifically from about 10,000 to about 150,000, a number average molecular weight Mn of, for example, from about 1,000 to about 60,000, and more specifically, from about 3,000 to about 50,000.

The crystalline resin can possess various melting points of, for example, from about 30° C. to about 120° C., such as from about 50° C. to about 90° C., and, for example, a number average molecular weight (Mn), as measured by gel permeation chromatography (GPC) of, for example, from about 1,000 to about 50,000, such as from about 2,000 to about 25,000; with a weight average molecular weight (Mw) of the resin of, for example, from about 2,000 to about 100,000, such as from about 3,000 to about 80,000, as determined by GPC using polystyrene standards. The molecular weight distribution (Mw/Mn) of the crystalline resin is, for example, from about 2 to about 6, such as from about 2 to about 4.

In embodiments, the crystalline resin may be present in the toner composition in amounts of from about 5 weight percent to about 40 weight percent, such as from about 5 weight percent to about 30 weight percent or from about 15 weight percent to about 25 weight percent, of the total toner composition.

The crystalline resins may be prepared by a polycondensation process of reacting an organic diol, and an organic diacid in the presence of a polycondensation catalyst, although making the crystalline polyester resin need not be limited to such a process. Generally, an about stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized may vary, and can be selected in an amount, for example, of from about 0.01 to about 1 mole percent of the resin. Additionally, in place of an organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The amount of organic diol selected can vary, and may be from about 25 to about 75 mole percent of the resin, such as from about 40 to about 60 or from about 45 to about 52 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid or diester may be selected, for example, in an amount of from about 25 to about 75 mole percent of the resin, such as from about 40 to about 60 or from about 45 to about 52 mole percent of the resin.

In embodiments, the crystalline resin disclosed herein is treated with a nucleating agent in order to increase the overall crystallization rate of the resin. "Crystallization rate" is the temperature at which crystallization is occurring at a maximum rate ($T_c$ peak temperature) measured by DSC (differential scanning calorimetry) and cooling at a defined rate from the polymer melt. As described herein, the "crystallization rate" is the change in ΔH, or total crystallinity change, instead of rate of crystallinity. The higher the $T_c$ peak temperature, the more effective the nucleating agent is in its ability at nucleating the polyester, thus effecting the crystallization rate of the resin. For example, the $T_c$ of a nucleated resin may increase in comparison to an untreated resin from about 2° C. to about 10° C., that is, the $T_c$ may change from about 54° C. in an untreated resin without a nucleating agent to about 58° C. in a nucleated resin. Thus, the $T_c$ of the resin may increase from about 1 percent to about 20 percent after treatment with a nucleating agent, such as from about 2 percent to about 15 percent or from about 2 percent to about 10 percent after treatment with a nucleating agent.

The crystalline resin may be treated with the nucleating agent during the process of generating a crystalline resin emulsion, thus generating an emulsion having a nucleated crystalline resin. In embodiments, the crystalline resin is nucleated by adding from about 0.01 percent to about 10 percent nucleating agent by weight of the crystalline resin emulsion, such as from about 1 percent to about 6 percent or from about 1.5 percent to about 5 percent, by weight of the crystalline resin emulsion.

In further embodiments, the overall crystallinity of the toner particles may be increased by adding the nucleating agents to a pre-toner mixture comprising the crystalline resin emulsion and the amorphous resin emulsion, as described below. Without limiting the present disclosure, it is believed that adding the nucleating agent to the pre-toner mixture as described below will cause the crystalline resin of the pre-toner mixture to become nucleated similar to the crystalline resin being nucleated in other embodiments.

Examples of suitable nucleating agents for treating the crystalline resin include metal salts of organic acids, benzoic acid compounds, cyclic bis-phenol phosphates, fillers, talc and certain pigment colorants. In embodiments, the nucleating agent is a saturated or unsaturated bicyclic dicarboxylic salt, or cyclic dicarboxylate salt, combinations thereof or salts thereof, such as HYPERFORM® HPN-68L, available from Milliken Chemical. In further embodiments, the nucleating agent suitable for use herein has the formula

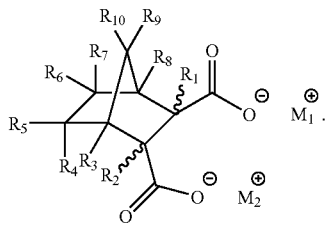

$M_1$ and $M_2$ may be the same or different metal or organic cations or the two metal ions are unified into a single metal ion (bivalent, calcium). The metal cations may be calcium, strontium, barium, magnesium, aluminum, silver, sodium, lithium, rubidium, potassium and the like. $R_1$ through $R_{10}$ may be any of a hydrogen, an alkyl having from about 1 to about 9 carbon atoms, a hydroxyl, an alkoxy having from about 1 to about 9 carbon atoms, an alkylenoxy having from about 1 to about 9 carbon atoms, an amine, an alkylamine halogen having from about 1 to about 9 carbon atoms, a phenyl, an alkylphenyl, and a carbocyclic having from about 1 to about 9 carbon atoms.

When crystalline resins crystallize from a melt, the onset of the phase transformation is the formation of small nuclei. Once primary nucleation occurs, the crystals of the crystalline resin may grow and form spherical macrostructures called spherulites. The use of a nucleating agent as disclosed herein may lead to higher nucleus density, allowing for the formation of a larger number of spherulites during the cooling of the melt. In contrast, in a non-nucleated crystalline resin, the spherulites would be less numerous and smaller in size. Thus, adding a nucleating agent to the crystalline resin emulsion or to the pre-toner mixture may increase the overall crystallization rate of the resin emulsion or the pre-toner mixture, and thus improve charging and resistivity of the formed toner particles, hi embodiments, nucleating the crystalline resin may increase the overall crystallization rate in comparison to toner having untreated crystalline resins in an amount from about 1 percent to about 10 percent, such as from about 1 percent to about 8 percent or from about 1 percent to about 7 percent, in comparison to toners having untreated crystalline resins.

The amorphous resins, in embodiments, possess, for example, a number average molecular weight (Mn), as measured by GPC, of from about 10,000 to about 500,000, and such as from about 5,000 to about 250,000; a weight average molecular weight (Mw) of from about 20,000 to about 600,000, such as from about 7,000 to about 300,000, as determined by GPC using polystyrene standards; and a molecular weight distribution (Mw/Mn) of from about 1.5 to about 6, such as from about 2 to about 4.

In embodiments, the amorphous resin may be present in the toner composition in amounts of from about 40 weight percent to about 90 weight percent, such as from about 60 weight percent to about 90 weight percent or from about 70 weight percent to about 85 weight percent, of the total toner composition.

The linear amorphous resins are generally prepared by the polycondensation of an organic diol and a diacid or diester, at least one of which may be a sulfonated or a sulfonated difunctional monomer being included in the reaction, and a polycondensation catalyst. For the branched amorphous sulfonated resin, the same materials may be used, with the further inclusion of a branching agent such as a multivalent polyacid or polyol.

Examples of amorphous resins suitable for use herein include both branched and linear amorphous resins, and combinations of branched and linear amorphous resins. Specific examples of amorphous resins suitable for use herein include polyester resins, branched polyester resins, polyimide resins, branched polyimide resins, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resin, polyester, a polyamide, a polyester-imide, an alkali sulfonated polyamide, an alkali sulfonated polyimide, an alkali sulfonated polystyrene-acrylate, an alkali sulfonated polyester-imide, copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), copoly(ethoxylated bisphenol-A-maleate)copoly(ethoxylated bisphenol-A-5-sulfo-isophthalate), and combination thereof.

The amorphous resin may include crosslinked portions therein, for example such that the toner has a weight fraction of the microgel (a gel content) in the range of, for example, from about 0.001 to about 50 weight percent, such as from about 0.1 to about 40 weight percent or from about 1 to about 10 weight percent, of the amorphous polyester. The gel content may be achieved either by mixing in an amount of crosslinked material, or crosslinking portions of the amorphous polyester, for example by including a crosslinking initiator in the amorphous polyester. The initiators may be, for example, peroxides such as organic peroxides or azo-compounds, for example diacyl peroxides such as decanoyl peroxide, lauroyl peroxide and benzoyl peroxide, ketone peroxides such as cyclohexanone peroxide and methyl ethyl ketone, alkyl peroxy esters such as t-butyl peroxy neodecanoate, 2,5-dimethyl 2,5-di(2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di (benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as dicumyl peroxide, 2,5-dimethyl 2,5-di(t-butyl peroxy) hexane, t-butyl cumyl peroxide, bis(t-butyl peroxy) diisopropyl benzene, di-t-butyl peroxide and 2,5-dimethyl 2,5-di(t-butyl peroxy) hexyne-3, alkyl hydroperoxides such as 2,5-dihydro peroxy 2,5-dimethyl hexane, cumene hydroperoxide, t-butyl hydroperoxide and t-amyl hydroperoxide, and alkyl peroxyketals such as n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy) cyclohexane, 2,2-di(t-butyl peroxy) butane, ethyl 3,3-di(t-butyl peroxy) butyrate and ethyl 3,3-di(t-amyl peroxy) butyrate, azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), 1,1-di(t-butyl peroxy)-3,3,5-trimethylcyclohexane, combinations thereof and the like. The amount of initiator used is proportional to the degree of crosslinking, and thus the gel content of the polyester material. The amount of initiator used may range from, for example, about 0.01 to about 10 weight percent, such as from about 0.1 to about 5 weight percent or the amorphous polyester. In the crosslinking, it is desirable that substantially all of the initiator be used up. The crosslinking may be carried out at high temperature, and thus the reaction may be very fast, for example, less than 10 minutes, such as from about 20 seconds to about 2 minutes residence time.

Examples of diacid or diesters for the preparation of amorphous include dicarboxylic acids or diesters may include terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester may comprise, for example, in an amount of from about 25 to about 75 mole percent of the resin, such as from about 40 to about 60 or from about 45 to about 52 mole percent of the resin. Examples of diols utilized in generating the amorphous resin include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and mixtures thereof. The amount of organic diol selected may vary and may be in an amount of from about 25 to about 75 mole percent of the resin, such as from about 40 to about 60 or from about 45 to about 52 mole percent of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.3 to about 2 weight percent of the resin may be selected.

Branching agents for use in forming the branched amorphous sulfonated resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Polycondensation catalyst examples for either the crystalline or amorphous resins include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Other examples of amorphous resins that are not amorphous polyester resins that may be utilized herein include, for example, polystyrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-β-carboxyethyl acrylate), poly (styrene-butadiene-acrylonitrile-β-carboxyethyl acrylate), poly(styrene-butyl acrylate-β-carboxyethyl acrylate), and poly(styrene-butyl acrylate-acrylononitrile-β-carboxyethyl acrylate).

An example of a method for generating a resin emulsion having a crystalline resin and a nucleating agent to form the nucleated crystalline resin is disclosed in U.S. Pat. No. 7,029,817, which is incorporated herein in its entirety by reference. EA toner dispersions may be generated by other processes including, but not limited to, the melt mixing process disclosed in Ser. No. 11/094,413, which is incorporated herein in its entirety by reference.

The polyester toner particles may be created by the emulsion/aggregation (EA) process, which are illustrated in a number of patents, such as U.S. Pat. No. 5,593,807, U.S. Pat. No. 5,290,654, U.S. Pat. No. 5,308,734, and U.S. Pat. No. 5,370,963, each of which are incorporated herein by reference in their entirety. The polyester may comprise any of the polyester materials described in the aforementioned references.

In embodiments, toner compositions may be prepared by any of the known emulsion-aggregation processes, such as a process that includes aggregating a mixture of an optional colorant, an optional wax and any other desired or required additives, and emulsions comprising the binder resins, and then coalescing the aggregate mixture. The resin emulsion may be prepared by dissolving resin in a suitable solvent. In embodiments, the resin emulsion is prepared by dissolving a crystalline resin and a nucleating agent in a solvent. Polyester emulsions, including any emulsions that contain crystalline polyester resin and/or amorphous polyester resin, may be similarly prepared.

Suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. If desired or necessary, the resin can be dissolved in the solvent at elevated temperature of from about 40° C. to about 80° C., such as from about 50° C. to about 70° C. or from about 60° C. to about 65° C., although the temperature is desirable lower than the glass transition temperature of the wax and resin. In embodiments, the resin is dissolved in the solvent at elevated temperature, but below the boiling point of the solvent, such as from about 2° C. to about 15° C. or from about 5° C. to about 10° C. below the boiling point of the solvent.

The resin is dissolved in the solvent, and is mixed into an emulsion medium, for example water such as deionized water containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present in amounts of from about 0.1 percent to about 5 percent, such as from about 0.5 percent to about 3 percent, by weight of the wax and resin. When such salts are added to the composition as a stabilizer, it is desired in embodiments that incompatible metal salts are not present in the composition. For example, when these salts are used, the composition should be completely or essentially free of zinc and other incompatible metal ions, for example, Ca, Fe, Ba, etc., that form water-insoluble salts. The term "essentially free" refers, for example, to the incompatible metal ions as present at a level of less than about 0.01 percent, such as less than about 0.005 percent or less than about 0.001 percent, by weight of the wax and resin. If desired or necessary, the stabilizer can be added to the mixture at ambient temperature, or it can be heated to the mixture temperature prior to addition.

Optionally, an additional stabilizer such as a surfactant may be added to the aqueous emulsion medium such as to afford additional stabilization to the resin. Suitable surfactants include anionic, cationic and nonionic surfactants. In embodiments, the use of anionic and nonionic surfactants can additionally help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN R-K available from Daiichi Kogyo Seiyaku Co. Ltd. (Japan), or TAYCAPOWER BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a suitable cationic surfactant is SANISOL B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc Inc. as IGEPAL CA-210, IGEPAL CA-520, IGEPAL CA-720, IGEPAL CO-890, IGEPAL CG-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

After the stabilizer or stabilizers are added, the resultant mixture can be mixed or homogenized for any desired time.

Next, the mixture is heated to flash off the solvent, and then cooled to room temperature. For example, the solvent flashing can be conducted at any suitable temperature above the boiling point of the solvent in water that will flash off the solvent, such as a temperature of from about 60° C. to about 100° C., such as from about 70° C. to about 90° C. or about 80° C., although the temperature may be adjusted based on, for example, the particular wax, resin, and solvent used.

Following the solvent flash step, the polyester resin emulsion, in embodiments have an average particle diameter in the range of from about 100 to about 500 nanometers, such as from about 130 to about 300 nanometers as measured with a Honeywell MICROTRAC® UPA150 particle size analyzer.

A pre-toner mixture is prepared by combining the colorant, and optionally a wax or other materials, surfactant, and both the crystalline and amorphous emulsions, which may be two or more emulsions that contain either the crystalline polyester resin or the amorphous resin. In embodiments, the pH of the pre-toner mixture is adjusted to from about 2.5 to about 4. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at from about 600 to about 4,000 revolutions per minute. Homogenization may be accomplished by any suitable means, including, for example, an TKA ULTRA TURRAX T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature ($T_g$) of the emulsion resin. In some embodiments, the aggregating agent may be added in an amount of from about 0.05 to about 3.0 pph and from about 1.0 to about 10 pph with respect to the weight of toner. The aggregating agent may be added to the pre-toner mixture over a period of from about 0 to about 60 minutes. Aggregation may be accomplished with or without maintaining homogenization. Aggregation is accomplished at temperatures that are may be greater than about 60° C.

In embodiments, although either a multivalent salt, such as polyaluminum chloride, or a divalent salt, such as zinc acetate, may be used, and the toner formulations may be identical for both aggregating agents, the process of preparing the toner particles is different. A divalent cation material may be used in embodiments in which the binder includes both linear amorphous and crystalline polyesters. In the case of the multivalent salt, anion and nonionic surfactants may be added to the latex mixture to stabilize the particle and reduce the shocking when a multivalent aggregating agent like PAC is added. PAC may be added at room temperature (cold addition) to initiate aggregation in the presence of the pigment, since the addition of PAC at elevated temperature may not be effective. In embodiments in which divalent salts are used as aggregating agents, the agent may be added at elevated temperature, for example about 50 to 60° C. (hot addition) as opposed to cold addition. The primary reason for this is that zinc acetate dissociates itself into the aqueous phase and the particle (pKa of zinc acetate is about 4.6). The dissociation is temperature dependent as well as pH dependent. When zinc acetate is added at elevated temperature, the temperature factor is minimized or eliminated. The amount of zinc acetate added can controlled to control the particle size, while in the case of cold addition of zinc acetate, neither of these parameters can be controlled.

Thus, the process calls for blending the crystalline polyester resin and the linear and/or branched amorphous polyester resin emulsions, together in the presence of a pigment and optionally a wax or other additives, all comprising submicron particles, heating the blend from room temperature to about 60° C., followed by addition of zinc acetate solution. The temperature may be slowly raised to 65° C. and held there for from about 3 hours to about 9 hours, such as about 6 hours, in order to provide from about 6 micron to about 12 micron particles, such as about 9 micron particles, that the have a shape factor of, for example, about 115 to about 130 as measured on the FPIA SYSMEX analyzer.

When a multivalent ion like PAC is used as the aggregating agent, it may be added cold as discussed above. Thus, the process steps are different than with zinc acetate, and calls for the addition of surfactants to the latex blend, followed by the addition of the pigment and optional additives. The surfactant stabilizes the particles by either electrostatic or steric forces or both, to prevent massive flocculation, when the aggregating agent is added. The pH of the blend containing the blend of toners, pigment, optional additives (wax), etc. is adjusted from about 5.6 to about 3.0 with 0.1 M nitric acid, followed by the addition of PAC, while being polytroned at speeds of about 5000 rpm. The temperature of the mixture is raised from room temperature to 55° C., and slowly in stages to about 70° C. in order to coalesce the particles. No pH adjustment is required to stabilize the particle size in either of the two aggregating agent processes.

Following aggregation, the aggregates may be coalesced. Coalescence may be accomplished by heating the aggregate mixture to a temperature that is about 5° C. to about 20° C. above the $T_g$ of the amorphous resin. Generally, the aggregated mixture is heated to a temperature of about 50° C. to about 80° C. In embodiments, the mixture may also be stirred at from about 200 to about 750 revolutions per minute to coalesce the particles. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

After coalescence, the mixture may be cooled to room temperature. After cooling, the mixture of toner particles of some embodiments may be washed with water and then dried. Drying may be accomplished by any suitable method for drying including freeze drying, Freeze drying is typically accomplished at temperatures of about −80° C. for a period of about 72 hours.

Upon aggregation and coalescence, the toner particles of embodiments have an average particle size of from about 1 to about 15 microns, in further embodiments of from about 4 to about 15 microns, and, in particular embodiments, of from about 6 to about 11 microns, such as about 7 microns. The volume geometric size distribution ($GSD_v$) of the toner particles of embodiments may be in a range of from about 1.20 to about 1.35, and in particular embodiments of less than about 1.25.

In embodiments, the process may include the use of surfactants, emulsifiers, and other additives such as those discussed above. Likewise, various modifications of the above process will be apparent and are encompassed herein.

The toner particles described herein may further include other components, such as colorants, waxes and various external additives. Colorant includes pigment, dye, mixtures of dyes, mixtures of pigments, mixtures of dyes and pigments, and the like.

When present, the colorant may be added in an effective amount of, for example, from about 1 to about 25 percent by weight of the particle, such as in an amount of from about 2 to about 12 weight percent. Suitable example colorants include, for example, carbon black like REGAL 330® magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorohenzidene acetoacetanilides, a monoazo pigment identified in the Color Index as CI 12700. CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan FI (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet 14300 (BASF).

Optionally, a wax can be present in an amount of from about 4 to about 12 percent by weight of the particles. Examples of waxes, if present, include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VIS COL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

Any suitable surface additives may be selected. Examples of additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; alternate metal oxides such as aluminum oxide, and as a lubricating agent, for example, stearates or long chain alcohols, such as UNXLIN 700™, and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability.

The $SiO_2$ and $TiO_2$ should more specifically possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50 percent silica/50 percent titania to about 85 percent silica, 15 percent titania (on a weight percentage basis).

Examples of suitable $SiO_2$ and $TiO_2$ are those surface treated with compounds including DTMS (decyltrimethoxysilane) or HMDS (hexamethyldisilazane). Examples of these additives are NAX50 silica, obtained from DeGussa/Nippon Aerosil Corporation, coated with HMDS; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85 percent purity, for example from about 85 to about 100 percent pure, for the 85 percent (less than 12 percent calcium oxide and free fatty acid by weight, and less than 3 percent moisture content by weight) and which has an average particle diameter of about 7 microns and is available from Ferro Corporation (Cleveland, Ohio). Examples are SYNPRO® Calcium Stearate 392A and SYNPRO® Calcium Stearate NF Vegetable or Zinc Stearate-L. Another example is a commercially available calcium stearate with greater than 95 percent purity (less than 0.5 percent calcium oxide and free fatty acid by weight, and less than 4.5 percent moisture content by weight), and which stearate has an average particle diameter of about 2 microns and is available from NOF Corporation (Tokyo, Japan). In embodiments, the toners contain from, for example, about 0.1 to about 5 weight percent titania, about 0.1 to about 8 weight percent silica, or from about 0.1 to about 4 weight percent calcium or zinc stearate.

Nucleating the crystalline resins with a nucleating agent as described herein raises the A-zone and C-zone charge distribution of the toner particles. In embodiments, the desired charge distribution for the toner particles in both the A-zone and the C-zone is from about −2 mm to about −25 mm displacement, such as from about −4 mm to about −20 mm displacement.

The charge performance or distribution of a toner is frequently demarcated as q/d (mm). The toner charge (q/d) is measured as the midpoint of the toner charge distribution. The charge is reported in millimeters of displacement from, the zero line in a charge spectrograph using an applied transverse electric filed of 100 volts per cm. The q/d measure in mm can be converted to a value in fC/μm by multiplying the value in mm by 0.092.

In embodiments, it is desired that the ratio of the charge distribution in the A-zone to the C-zone be as close to 1 as possible. This ratio (C-zone/A-zone) is frequently referred to as the relative humidity (RH) sensitivity by those skilled in the art. In embodiments, the RH sensitivity may be in a range of less than about 10, such as from about 0.03 to about 8.

The toner described herein comprises a nucleated crystalline resin and an amorphous resin, and has a resistivity of at least about $1\times10^{11}$ ohm-cm, such as greater than about $1\times10^{12}$ ohm-cm or greater than about $3\times10^{12}$ ohm-cm. As is known in the art, toner particles having an increase resistivity will demonstrate an improved charge performance.

Toner cohesion is typically expressed in percent cohesion. Percent cohesion may be measured by weighing about five grams of parent particles into a foil dish and conditioning in an environmental chamber at about 40° C. and about 85% relative humidity. After about 17 hours, the samples are removed and acclimated at ambient temperature for at least about 30 minutes. Each re-acclimated sample is then poured into a stack of two pre-weighed mesh sieves, which were stacked as follows: 1000 micron on top and 106 micron on bottom. The sieves are vibrated for about 90 seconds at about 1 mm amplitude with a Hosokawa flow tester. After the vibration is completed the sieves are reweighed and toner heat cohesion was calculated from the total amount of toner remaining on both sieves as a percentage of the starting weight. All screens are desirably made of stainless steel, hi embodiments, the percent cohesion is calculated as follows:

$$\%\ \text{cohesion}=(A+B)/C\times100,$$

where A is the mass of toner remaining on the 1000 micron screen, B is the mass of toner remaining on the 106 micron screen, and C is the total mass of the toner placed on top of the set of stacked screens (5 grams in the example above). The percent cohesion of the toner is related to the amount of toner remaining on each of the screens at the end of the time. A percent cohesion value of 100 percent corresponds to ail the toner remaining on the top screen at the end of the vibration step (20×5 grams=100) and a percent cohesion of 0 percent corresponds to all of the toner passing through both screens, in other words, no toner remaining on either of the screens at the end of the vibration step. The greater the percent cohesion for toners, the less the toner particles are able to flow. In embodiments, the toners may have a percent cohesion in the range of, for example, from about 1 percent to about 40 percent, such as from about 5 percent to about 35 percent.

The toner particles of all embodiments may be included in developer compositions. In embodiments, developer compositions comprise toner particles, such as those described above, mixed with carrier particles to form a two-component developer composition. In some embodiments, the toner concentration in the developer composition may range from about 1 weight percent to about 25 weight percent, such as from about 2 weight percent to about 15 weight percent, of the total weight of the developer composition.

Examples of carrier particles suitable for mixing with the toner include those particles that are capable of triboelectrically obtaining a charge of opposite polarity to that of the toner particles, such as granular zircon, granular silicon, glass, steel, nickel, ferrites, iron ferrites, silicon dioxide, and the like.

The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In applications in which the described toners are used with an image-developing device employing roll fusing, the carrier core may be at least partially coated with a polymethyl methacrylate (PMMA) polymer having a weight-average molecular weight of 300,000 to 350,000, e.g., such as commercially available from Soken. PMMA is an electropositive polymer that will generally impart a negative charge on the toner by contact. The coating has, in embodiments, a coating weight of from about 0.1 weight percent to about 5 weight percent, or from about 0.5 weight percent to about 2 weight percent of the carrier, PMMA may optionally be copolymerized with any desired comonomer, such that the resulting copolymer retains a suitable particle size. Suitable comonomers can include monoalkyl, or dialkyl amines, such as dimethylaminoethyl methacrylates, diethylaminoethyl methacrylates, diisopropylaminoethyl methacrylates, tert-butyl amino ethyl methacrylates, and the like, and mixtures thereof. The carrier particles may be prepared by mixing the carrier core with from about 0.05 weight percent to about 10 weight percent of polymer, such as from about 0.05 weight percent to about 3 weight percent of polymer, based on the weight of the coated carrier particles, until the polymer coating adheres to the carrier core by mechanical impaction and/or electrostatic attraction. Various effective suitable means can be used to apply the polymer to the surface of the carrier core particles, for example, cascade-roll mixing, tumbling, milling, shaking, electrostatic powder-cloud spraying, fluidized bed, electrostatic disc processing, and with an electrostatic curtain. The mixture of carrier core particles and polymer is then heated to melt and fuse the polymer to the carrier core particles. The coated carrier particles are then cooled and classified to a desired particle size.

Carrier particles can be mixed with toner particles in any suitable combination in embodiments. In some embodiments, for example, about 1 to about 5 parts by weight of toner particles are mixed with from about 10 to about 300 parts by weight of the earner particles.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers of the invention via a suitable image development method such as any one of the aforementioned methods, the image is then transferred to an image receiving medium such as paper and the like. In an embodiment of the present invention, it is desired that the toners be used in developing an image in an image-developing device utilizing a fuser roll member. Fuser roll members are contact fusing devices that are well known in the art, in which heat and pressure from the roll are used in order to fuse the toner to the image-receiving medium. Typically, the fuser member may be heated to a temperature just above the fusing temperature of the toner, that is, to temperatures of from about 80° C. to about 150° C. or more.

Embodiments described above will now be further illustrated by way of the following examples.

EXAMPLES

Resin Example I

Crystalline Resin and 2 Weight Percent Nucleating Agent

In a 2 L beaker, about 547.11 grams of deionized water was heated to about 80° C. Meanwhile, in a 500 ml beaker, about 305 g of acetone, about 27.88 g of crystalline resin made from dodecanedioc acid, sebacic acid, 5-lithium sulfoisophthalic acid and ethylene glycol, and about 0.5576 g of HYPERFORM® HPN-68L available from Milliken Chemical (a nucleating agent) were stirred together and heated to about 55° C. to dissolve the resin and nucleating agent in the acetone.

This acetone/resin mixture was added drop wise via a Pasteur pipette to the heated deionized water. The acetone was removed by distillation. Any particles over 20 microns were removed by screening through a 20 micron sieve followed by centrifuging the remaining emulsion at about 3000 rpm for about 3 minutes to further isolate and remove larger particles.

Resin Example II

Unsaturated Crystalline Resin and 4.77 Weight Percent Nucleating Agent

In a 2 L beaker, about 109.16 g of unsaturated crystalline resin made from dodecanoic acid, fumaric acid and ethylene glycol, was weighed out. About 5.47 g of HPN-68L was added into the same beaker and about 1289 g of ethyl acetate was added as the organic solvent. The crystalline resin/nucleating was dissolved in the ethyl acetate by heating to about 65° C. on a hot plate for about 1 hour at about 200 rpm. Meanwhile, in a 4 L beaker, about 1197 g of deionized water and about 2.8 weight percent (based on resin weight of about 3.21 g) of Tayca Power anionic surfactant were homogenized at about 6400 rpm at about 65° C.

The molten resin/nucleating agent solution was slowly poured into the water solution as the mixture continued to be homogenized. The homogenization speed was increased to about 10,000 rpm and the mixture was kept at about 65° C. for a total of about 35 minutes at 10,000 rpm. The homogenized mixture was poured into a 3 L heat jacketed Pyrex distillation apparatus and stirred at about 260 rpm. The temperature was ramped to about 80° C. over about 1° C. per minute and held at about 80° C. for about 125 minutes to distill off the ethyl acetate from the water/resin emulsion.

The pH of the crystalline resin emulsion was adjusted to about 7.22 with about 1M LiOH to maintain stability of particles. The emulsion was removed from the distillation apparatus and poured through a 20 micron sieve to remove larger particles and then centrifuged at about 3000 rpm for about 3 minutes to remove any residual large particles. The particle size of the emulsion was about 173 nm, and solids content was about 10.77 percent.

Comparative Resin Example III

Crystalline Resin and No Nucleating Agent

In a 2 L beaker, about 100 g of crystalline resin and about 1000 g of acetone were stirred and heated to about 65° C. In a 4 L beaker, about 1000 g of deionized water and about 2.5 percent (based on resin weight of about 2.5 g) of Tayca Power anionic surfactant were homogenized at about 6400 rpm while heating to about 65° C. The resin solution was slowly poured into the homogenizing water and homogenization was continued for about 30 minutes at about 10,000 rpm. The homogenized mixture was poured into a heat jacketed Pyrex distillation apparatus and stirred at about 300 rpm. The temperature was ramped to about 80° C. over about 1° C. per minute and held at about 80° C. for about 120 minutes to distill off the ethyl acetate from the water/resin emulsion. The pH of the crystalline resin emulsion was adjusted to about 7.0 with about 1M LiOH to maintain stability of particles.

The emulsion was removed from distillation apparatus and poured through a 20 micron sieve to remove larger particles and then centrifuged at about 3000 rpm for about 3 minutes to remove any residual large particles. The particle size of the emulsion was about 200 nm, and the solids content was about 10.42 percent.

Comparative Resin Example IV

Unsaturated Crystalline Resin and No Nucleating Agent

In a 2 L beaker, about 100 g of unsaturated crystalline resin and about 1000 g of acetone were stirred and heated to about 65° C. In a 4 L beaker, about 1000 g of deionized water and about 2.5 percent (based on resin weight of about 2.5 g) of Tayca Power anionic surfactant were homogenized at about 6400 rpm while heating to about 65° C. The resin solution was slowly poured into the homogenizing water and homogenization was continued for about 30 minutes at about 10,000 rpm. The homogenized mixture was poured into a heat jacketed Pyrex distillation apparatus and stirred at about 300 rpm. The temperature was ramped to about 80° C. over about 1° C. per minute and held at about 80° C. for about 120 minutes to distill off the ethyl acetate from the water/resin emulsion.

The pH of the crystalline resin emulsion was adjusted to about 7.0 with about 1M LiOH to maintain stability of particles. The emulsion was removed from the distillation apparatus and poured through a 20 micron sieve to remove larger particles and then centrifuged at about 3000 rpm for about 3 minutes to remove any residual large particles. The particle size of the emulsion was about 289 nm, and the solids content was about 14.55 percent.

As tabulated in Table 1, the differential scanning calorimeter (DSC) is a tool for measuring changes in crystallinity in polymers. The percent change in recrystallization is calculated by subtracting the ΔH ($2^{nd}$ melt $T_m$) of samples with nucleator from the control, then dividing the difference by the control ΔH ($2^{nd}$ melt $T_m$) and multiplying by 100. $T_c$ refers to the temperature of crystallization. The results verify that adding a nucleating agent to the crystalline resin or unsaturated crystalline resin increases the amount of crystallinity in the polymer.

TABLE 1

Nucleating Agent Loadings and Data

| | Wt % Nucleating Agent | $T_m$ (° C.) | $T_c$ (° C.) | $T_m$ (° C.) $2^{nd}$ melt | ΔH (J/g) for $2^{nd}$ melt $T_m$ | % Change in Recrystallization |
|---|---|---|---|---|---|---|
| Comparative Resin Example III | 0% | 75.66 | 54.08 | 68.16 | 71.55 | +1.16 |
| Resin Example I | 2% | 71.09 | 57.59 | 68.68 | 72.38 | |
| Comparative Resin Example IV | 0% | 19.06 | 59.35 | 78.67 | 69.10 | +5.60 |
| Resin Example II | 4.77% | 79.20 | 61.13 | 74.85 | 72.97 | |

Following are examples are described for the fabrication of toner containing nucleated crystalline resin and nucleated unsaturated crystalline resin. The comparative toners would be those made with untreated crystalline resin and untreated unsaturated crystalline resin.

Toner Example 1

Preparation of Toner Containing the Nucleated Crystalline Resin in Resin Example I A 2 liter glass kettle was charged with about 338.75 grams of emulsion from Resin Example I comprised of nucleated crystalline resin in water, about 404.59 grams of a branched sulfonated amorphous resin in water/surfactant, about 22.24 g of cyan pigment dispersion and about 37.30 g of carnauba wax. The percent ratio of this formulation was about 21.625 percent nucleated crystalline resin, about 64.875 percent branched sulfonated amorphous resin, about 4.5 percent cyan pigment and about 9.0 percent carnauba wax. Thus, the ratio of nucleated crystalline resin to branched sulfonated amorphous resin was about 25:75.

After uniform mixing, the pH of the slurry was adjusted from a pH of about 6.34 to a pH of about 3.98 with 1 N solution of nitric acid. An about 3.0 weight percent zinc acetate dehydrate solution (about 2.11 g zinc acetate dehydrate in about 38.24 g deionized water with about 8.88 g 1 N nitric acid), which was adjusted from a pH of about 6.37 to about pH of about 4.19 with about 8.88 g 1N nitric acid, was added at ambient temperature, about 25° C., via a peristaltic pump over about 16 minutes to the pre-toner slurry while homogenizing the slurry with an TKA Ultra Turrax T50 probe homogenizer at about 3000 rpm.

As the slurry began to thicken the homogenizer rpm was increased to about 4000 while shifting the beaker side-to-side. This pre-toner slurry was transferred to a heating mantle equipped with a 45 degree angle blade mechanical stirrer. The heating was programmed to reach about 40° C. over about 30 minutes with stirring at about 790 revolutions per minute. The particle size was monitored using a Multisizer II Beckman Coulter. Once the particle size $D_{50}$ was about 5.8 μm, the pH of the slurry was increased to about 5.8 with about 1M NaOH to slow particle growth.

Next was added, about 1.26 percent EDTA (relative to resin weight, about 2.27 g) to sequester any residual zinc ions and further increase the pH of the slurry to about 6.0. At this point, the particle $D_{50}$ was stabilized and the temperature was slowly ramped to about 75° C. to coalesce the toner particles. The reaction was turned off or heating was stopped once the particles coalesced at about 75° C. with a total reaction time of about 172 minutes. The toner slurry was cooled to about ambient temperature, about 25° C., while still stirring the slurry at about 790 rpm.

A sample (about 0.25 gram) of the reaction mixture was then retrieved from the kettle and a $D_{50}$ particle size of about 5.90 microns with a GSD of about 1.32 was measured by the Coulter Counter. The product was filtered through an about 25 micron stainless steel screen, left in its mother liquor and settled overnight. The following day, the mother liquor, which contained fines, was decanted from the toner cake which settled to the bottom of the beaker. The settled toner was reslurried in about 1.5 liter of deionized water, stirred for about 30 minutes, and filtered through a Büchner funnel containing about 3 μm-sized filter paper. This procedure was repeated once more until the solution conductivity of the filtrate was measured to be about 30 microsiemens per centimeter, which indicated that the washing procedure was sufficient. The toner cake was redispersed into about 300 milliliters of deionized water, and freeze-dried over about 72 hours. The final dry yield of toner was estimated to be about 76.9 percent of the theoretical yield.

Toner Example 2

Preparation of Toner Containing the Nucleated Unsaturated Crystalline Resin in Resin Example II A 2 liter glass kettle was charged with about 64.25 grams of emulsion from Resin Example II comprised of nucleated unsaturated crystalline resin in water/surfactant, about 245.17 grams of branched amorphous resin in water/surfactant, about 10.91 g of cyan pigment dispersion and about 18.89 g carnauba wax. The percent ratio of this formulation was about 17.3 percent nucleated unsaturated crystalline resin, about 69.2 percent branched amorphous resin, about 4.5 percent cyan pigment and about 9.0 percent carnauba wax. Thus, the ratio of the nucleated unsaturated crystalline resin to the branched amorphous resin was about 20:80.

After uniform mixing, the pH of the slurry was adjusted from a pH of about 3.91 to a pH of about 2.68 with 1 N solution of nitric acid. The slurry was then homogenized with an EKA Ultra Turrax T50 probe at about 4000 rpm and about 0.5 pph $Al_2(SO_4)_3$ relative to the toner was added drop wise to the slurry over about 8 minutes. The aggregant-doped slurry was transferred to a heating mantle equipped with a 45 degree angle blade mechanical stirrer. The heating was programmed to reach about 35° C. over about 30 minutes with stirring at about 900 revolutions per minute.

The particle size was monitored using Multisizer II Beckman Coulter. Once the particle size $D_{50}$ was about 6.55 μm, the pH of the slurry was increased to about 3.57 with about 1M LiOH to slow particle growth. The rpm was dropped to about 756 so that particles did not break apart during freezing. Next, about 0.73 pph EDTA (relative to resin weight; about 0.648 g) to sequester any residual aluminum ions and further increase the pH of the slurry to about 9.39 (with additional 1M LiOH as well) was added. At this point the particle $D_{50}$ was stabilized and the temperature was slowly ramped to about 93° C. to coalesce the toner particles. Once at about 93° C. for about 20 minutes, the pH of the slurry was dropped from about 7.07 to about 6.63 with about 0.02 N nitric acid to advance coalescence and improve circularity of the particles.

The reaction was turned off or heating was stopped once the particles coalesced at about 93° C. with a total reaction time of about 377 minutes. The toner slurry was cooled to about ambient temperature, about 25° C., while stirring the slurry at about 606 rpm. A sample (about 0.25 gram) of the reaction mixture was then retrieved from the kettle, and a $D_{50}$ particle size of about 5.04 microns with a GSD of about 1.30 was measured by the Coulter Counter. The circularity was measured to be about 0.924 with the Sysmex FPIA-2100 flow-type histogram analyzer. The product was filtered through a 25 micron stainless steel screen, left in its mother liquor and settled overnight.

The following day, the mother liquor, which contained fines, was decanted from the toner cake, which settled to the bottom of the beaker. The settled toner was reslurried in about 1.5 liter of deionized water, stirred for about 30 minutes, and filtered through a Büchner funnel containing about 3 μm-sized filter paper. The next wash was a heated acidification wash followed by one more deionized water wash. The toner cake was redispersed into about 300 milliliters of deionized water, and freeze-dried over about 72 hours. The final dry yield of toner was estimated to be about 64.9 percent of the theoretical yield.

Toner Example III

Preparation of Toner Containing the Nucleated Unsaturated Crystalline Resin in Resin Example II A 2 liter glass kettle was charged with about 48.84 grams of emulsion from Resin Example II comprised of nucleated unsaturated crystalline resin in water/surfactant, about 185.66 grams of branched amorphous resin in water/surfactant, about 8.30 g of cyan pigment dispersion and about 24.36 g of carnauba wax. The percent ratio of this formulation was about 17.3 percent nucleated unsaturated crystalline resin, about 69.2 percent branched amorphous resin, about 4.5 percent cyan pigment and about 9.0 percent carnauba wax. Thus, the ratio of the nucleated unsaturated crystalline resin to the branched amorphous resin was about 20:80.

After uniform mixing, the pH of the slurry was adjusted from around a pH of about 3.97 to a pH of about 2.70 with 1 N solution of nitric acid. The slurry was then homogenized with an TKA Ultra Turrax T50 probe at about 4000 rpm and about 0.5 pph $Al_1(SO_4)_3$ relative to toner was added drop wise to the slurry over about 7.5 minutes. The aggregant-doped slurry was transferred to a heating mantle equipped with a 45 degree angle blade mechanical stirrer. The heating was programmed to reach about 40° C. over about 40 minutes with stirring at 830 revolutions per minute.

The particle size was monitored using Multisizer II Beckman Coulter. Once the particle size $D_{50}$ was around 6.2 μm, the pH of the slurry was increased to about 4.29 with about 1M LiOH to slow particle growth. The rpm was dropped to about 600 so that particles did not break apart during freezing. Next, about 0.91 pph EDTA (relative to resin weight; about 0.239 g) to sequester any residual aluminum ions and further increase the pH of the slurry to about 9.40 (with additional 1M LiOH as well) was added. At this point, the particle $D_{50}$ was stabilized and the temperature was slowly ramped to about 93° C. to coalesce the toner particles. Once at about 93° C. for about 7 minutes, the pH of the slurry was dropped from about 7.18 to about 6.55 with about 0.02 N nitric acid to advance coalescence and improve circularity of the particles.

The reaction was turned off or heating was stopped once the particles coalesced at about 93° C. with a total reaction time of about 133 minutes. The toner slurry was cooled to about ambient temperature, about 25° C., while stirring the slurry at about 540 rpm. A sample (about 0.25 gram) of the reaction mixture was then retrieved from the kettle and a $D_{50}$ particle size of about 5.37 microns with a GSD of about 1.31 was measured by the Coulter Counter. The circularity was measured to be about 0.940 with the Sysmex FPIA-2100 flow-type histogram analyzer.

The product was filtered through a 25 micron stainless steel screen, left in its mother liquor and settled overnight. The following day, the mother liquor, which contained fines, was decanted from the toner cake, which settled to the bottom of the beaker. The settled toner was reslurried in about 1.5 liter of deionized water, stirred for about 30 minutes, and filtered through a Büchner funnel containing about 3 μm-sized filter paper. The next wash was a heated acidification wash followed by one more deionized water wash. The toner cake was redispersed into about 300 milliliters of deionized water, and freeze-dried over about 72 hours. The final dry yield of toner was estimated to be about 76.1 percent of the theoretical yield.

Comparative Toner Example 4

Preparation of Toner Containing Untreated Crystalline Resin as in Comparative Resin Example III A 2 liter glass kettle was charged with about 207.58 grams of emulsion from Comparative Resin Example III comprised of untreated crystalline resin in water/surfactant, 4 about 96.78 grams of branched sulfonated amorphous resin in water/surfactant, about 27.27 g of cyan pigment dispersion and about 47.37 g of carnauba wax. The percent ratio of this formulation was about 21.625 percent untreated crystalline resin, about 64.875 percent branched sulfonated amorphous resin, about 4.5 percent cyan pigment and about 9.0 percent carnauba wax. Thus, the ratio of nucleated crystalline resin to branched sulfonated amorphous resin was about 25:75.

After uniform mixing, the pH of the slurry was adjusted from a pH of about 5.99 to a pH of about 3.98 with 1 N solution of nitric acid. About 2.3 weight percent zinc acetate dehydrate solution (about 2.00 g zinc acetate dehydrate in about 28.02 g deionized water with about 9.81 1N nitric acid), which was adjusted from a pH of about 6.46 to a pH of about 4.21 with about 9.81 g 1N nitric acid, was added at about ambient temperature, about 25° C., via a peristaltic pump over about 5 minutes to the pre-toner slurry while homogenizing the slurry with an DCA Ultra Turrax T50 probe homogenizer at about 3000 rpm.

As the slurry began to thicken, the homogenizer rpm was increased to about 4000 while shifting the beaker side-to-side. This pre-toner slurry was transferred to a heating mantle equipped with a 45 degree angle blade mechanical stirrer. The heating was programmed to reach about 43° C. over about 20 minutes with stirring at about 775 revolutions per minute. The particle size was monitored using Multisizer II Sectarian Coulter. Once the particle size $D_{50}$ was around 5.5 μm, the pH of the slurry was increased to about 5.75 with about 1M NaOH to slow particle growth. Next, about 1.30 percent EDTA (relative to resin weight; about 2.89 g) to sequester any residual zinc ions and further increase the pH of the slurry to about 6.05, was added.

At this point, the particle $D_{50}$ was stabilized and the temperature was slowly ramped to about 75° C. to coalesce the toner particles. The reaction was turned off or heating was stopped once the particles coalesced at about 75° C. with a total reaction time of about 198 minutes. The toner slurry was cooled to about ambient temperature, about 25° C., while still stirring the slurry at about 587 rpm. A sample (about 0.25 gram) of the reaction mixture was then retrieved from the kettle and a $D_{50}$ particle size of about 5.83 microns with a GSD of about 1.35 was measured by the Coulter Counter. The product was filtered through a 25 micron stainless steel screen, left in its mother liquor and settled overnight.

The following day, the mother liquor, which contained fines, was decanted from the toner cake which settled to the bottom of the beaker. The settled toner was reslurried in about 1.5 liter of deionized water, stirred for about 30 minutes, and filtered through a Büchner funnel containing about 3 jam-sized filter paper. This procedure was repeated once more until the solution conductivity of the filtrate was measured to be about 5.8 microsiemens per centimeter which indicated that the washing procedure was sufficient. The toner cake was redispersed into about 300 milliliters of deionized water, and freeze-dried over about 72 hours. The final dry yield of toner was estimated to be about 72.7 percent of the theoretical yield.

Comparative Toner Example 5

Preparation of Toner Containing Untreated Unsaturated Crystalline Resin as in Comparative Resin Example IV Toner was fabricated the same as Toner 3 and Comparative Toner Example 4, but with the untreated unsaturated crystalline resin from Comparative Resin Example IV. The percent ratio of this formulation was about 17.3 percent untreated unsaturated crystalline resin, about 69.2 percent branched amorphous resin, about 4.5 percent cyan pigment and about 9.0 percent carnauba wax. Thus, the ratio of the untreated unsaturated crystalline resin to the branched amorphous resin was about 20:80. The final $D_{50}$ particle size was about 6.21 μm with a GSD of about 1.32. The final dry yield of toner was estimated to be about 96.4 percent of the theoretical yield.

Results

Measurement of Charging

Developer samples were prepared with about 0.5 g of the parent toner sample and about 10 g of the 35 micron solution coated carrier. A duplicate developer sample pair was prepared as above for each toner that was evaluated. One developer of the pair was conditioned overnight in A-zone, and the other was conditioned overnight in the C-zone environmental chamber. The following day, the developer samples were sealed and agitated for about 1 hour using a Turbula mixer. After about 1 hour of mixing the toner charge was measured using a charge spectrograph. The toner charge (q/d) was measured visually as the midpoint of the toner charge distribution. The charge is being reported in millimeters of displacement from the zero line.

Measurement of Blocking

About five grams of parent particles were weighed into a foil dish and conditioned in an environmental chamber at about 40° C. and about 85 percent relative humidity. After about 17 hours the samples were removed and acclimated at about ambient temperature for at least about 30 minutes. Each re-acclimated sample was then poured into a stack of two pre-weighed mesh sieves, which were stacked as follows: 1000 μm on top and 106 μm on bottom. The sieves were vibrated for about 90 seconds at about 1 mm amplitude with a Hosokawa flow tester. After the vibration was completed, the sieves were reweighed and toner heat cohesion was calculated from the total amount of toner remaining on both sieves as a percentage of the starting weight, as was discussed above.

Measurement of Toner Resistivity

About a 1 g sample of parent toner was conditioned overnight in the A-zone environmental chamber. The next day the sample from A-zone was pressed with about 2500 PSI pressure into pellet form using a piston and cylinder conductivity cell equipped with a hydraulic press. The resistance of the pressed toner sample was measured with a 10v potential using a high resistance meter. The length of the pellet was measured using a digital caliper, and the resistivity of the compressed sample was calculated.

TABLE 2

Results for Toners Having Nucleated Resins and Untreated Resins

| | A-Zone Charge (q/d) | C-Zone Charge (q/d) | A/C Ratio | Toner Cohesion in A-Zone | Resistivity in A-zone (ohm · cm) |
|---|---|---|---|---|---|
| Comparative Toner Example 4 | −2.14 | −24.56 | 0.087 | 91.0% | $2.4 \times 10^{12}$ |
| Toner Example 1 | −2.77 | −34.22 | 0.081 | 78.4% | $3.1 \times 10^{12}$ |
| Comparative Toner Example 5 | −0.84 | −2.47 | 0.34 | 47.3% | $7.2 \times 10^{12}$ |
| Toner Example 2 | −2.21 | −9.43 | 0.23 | 35.2% | $1.5 \times 10^{13}$ |
| Toner Example 3 | −1.15 | −3.21 | 0.36 | 18.5% | $3.8 \times 10^{12}$ |

As shown in Table 2, all toners made with nucleated crystalline resin or nucleated unsaturated crystalline resin demonstrated improvement in both A-zone and C-zone charging, toner cohesion and in most cases resistivity (with exception to Toner Example 3). Without limiting the disclosure, it is believe that process conditions effected final resistivity of Toner Example 3 in comparison to Toner Example 2 as the same resins were used in both Examples.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method comprising:

forming a crystalline resin emulsion comprising a crystalline resin, forming an amorphous resin emulsion comprising an amorphous resin, combining the crystalline resin emulsion and the amorphous resin emulsion to form a pre-toner mixture, adding a nucleating agent selected from the group consisting of a saturated or unsaturated bicyclic dicarboxylic salt, a cyclic dicarboxylate salt, or combinations thereof to the crystalline resin emulsion or the pre-toner mixture in order to nucleate the crystalline resin of the crystalline resin emulsion, and aggregating and coalescing the pre-toner mixture to form toner particles.

2. The method according to claim 1, wherein the nucleating agent is added in an amount of from about 0.01 percent to about 10 percent by weight of the crystalline resin emulsion.

3. The method according to claim 1, wherein the toner particles have a resistivity of at least about $1\times10^{12}$ ohm-cm.

4. The method according to claim 1, wherein the toner particles have a toner cohesion of from about 1 percent to about 40 percent.

5. The method according to claim 1, wherein the crystalline resin is a saturated crystalline resin or an unsaturated crystalline resin, and the amorphous resin is a linear amorphous resin and/or a branched amorphous resin.

6. A method comprising:

forming a crystalline resin emulsion comprising a crystalline resin, forming an amorphous resin emulsion comprising an amorphous resin, combining the crystalline resin emulsion and the amorphous resin emulsion to form a pre-toner mixture, adding a nucleating agent selected from the group consisting of metal salts of organic acids, cyclic bis-phenol phosphates and talc to the crystalline resin emulsion or the pre-toner mixture in order to nucleate the crystalline resin of the crystalline resin emulsion, and aggregating and coalescing the pre-toner mixture to form toner particles.

7. The method according to claim 1, wherein the crystalline resin is a crystalline resin selected from the group consisting of alkali copoly(5-sulfoisophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl)-copoly(propylene-succinate), alkali copoly(5-sulfo-isophthaloyl)-copoly(butylenes-succinate), alkali copoly(5-sulfo-isophthaloyl)-copoly(pentylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(hexylene-adipate), poly(octylene-adipate), and combinations thereof.

8. The method according to claim 1, wherein the crystalline resin is a semicrystalline resin selected from the group consisting of poly(3-methyl-1-butene), poly(hexamethylene carbonate), poly(ethylene-p-carboxy phenoxy-butyrate), poly (ethylene-vinyl acetate), poly(docosyl acrylate), poly (dodecyl acrylate), poly(octadecyl acrylate), poly(octadecyl methacrylate), poly(behenylpolyethoxyethyl methacrylate), poly(ethylene adipate), poly(decamethylene adipate), poly (decamethylene azelate), poly(hexamethylene oxalate), poly (decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithioneisophthalate), poly(methyl ethylene terephthalate), poly (ethylene-p-carboxy phenoxy-valerate), poly (hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

9. The method according to claim 1, wherein the amorphous resin is selected from the group consisting of a polyester, a polyamide, a polyimide, a polystyrene-acrylate, a polystyrene-methacrylate, a polystyrene-butadiene, a polyester-imide, an alkali sulfonated polyester, an alkali sulfonated polyamide, an alkali sulfonated polyimide, an alkali sulfonated polystyrene-acrylate, an alkali sulfonated polystyrene-methacrylate, an alkali sulfonated polystyrene-butadiene, an alkali sulfonated polyester-imide, and combinations thereof.

10. A method comprising:

forming a crystalline resin emulsion comprising a crystalline resin, forming an amorphous resin emulsion comprising an amorphous resin, combining the crystalline resin emulsion and the amorphous resin emulsion to form a pre-toner mixture, adding to the crystalline resin emulsion or the pre-toner mixture, in order to nucleate the crystalline resin of the crystalline resin emulsion, a nucleating agent having a formula of:

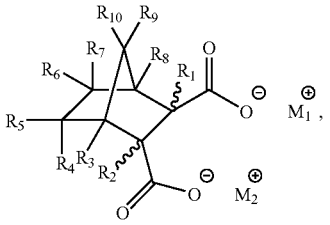

wherein $M_1$ and $M_2$ are the same or different metal cation or organic cation, or $M_1$ and $M_2$ are unified into a single bivalent metal ion, and wherein each of $R_1$ through $R_{10}$ is independently selected from the group consisting of a hydrogen, an alkyl having from about 1 to about 9 carbon atoms, a hydroxyl, an alkoxy having from about 1 to about 9 carbon atoms, an alkylenoxy having from about 1 to about 9 carbon atoms, an amine, an alkylamine halogen having from about 1 to about 9 carbon atoms, a phenyl, an alkylphenyl, and a geminal or vicinal carbocyclic having from about 1 to about 9 carbon atoms, and aggregating and coalescing the pre-toner mixture to form toner particles.

11. The method according to claim 10, wherein the nucleating agent is added in an amount of from about 0.01 percent to about 10 percent by weight of the crystalline resin emulsion.

12. The method according to claim 10, wherein the toner particles have a resistivity of at least about $1\times10^{12}$ ohm-cm.

13. The method according to claim 10, wherein the toner particles have a toner cohesion of from about 1 percent to about 40 percent.

14. The method according to claim 10, wherein the crystalline resin is a saturated crystalline resin or an unsaturated crystalline resin, and the amorphous resin is a linear amorphous resin and/or a branched amorphous resin.

15. The method according to claim 10, wherein the crystalline resin is a crystalline resin selected from the group consisting of alkali copoly(5-sulfoisophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly (5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly (octylene-adipate), alkali copoly(5-sulfo-isophthaloyl)-copoly(ethylene-succinate), alkali copoly(5-sulfo-isophthaloyl)-copoly(propylene-succinate), alkali copoly(5-sulfo-isophthaloyl)-copoly(butylenes-succinate), alkali copoly(5-sulfo-isophthaloyl)-copoly(pentylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly (propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(hexylene-adipate), poly(octylene-adipate), and combinations thereof.

16. The method according to claim 10, wherein the crystalline resin is a semicrystalline resin selected from the group consisting of poly(3-methyl-1-butene), poly(hexamethylene carbonate), poly(ethylene-p-carboxy phenoxy-butyrate), poly(ethylene-vinyl acetate), poly(docosyl acrylate), poly (dodecyl acrylate), poly(octadecyl acrylate), poly(octadecyl methacrylate), poly(behenylpolyethoxyethyl methacrylate), poly(ethylene adipate), poly(decamethylene adipate), poly (decamethylene azelate), poly(hexamethylene oxalate), poly (decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithioneisophthalate), poly(methyl ethylene terephthalate), poly (ethylene-p-carboxy phenoxy-valerate), poly (hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

17. The method according to claim 10, wherein the amorphous resin is selected from the group consisting of a polyester, a polyamide, a polyimide, a polystyrene-acrylate, a polystyrene-methacrylate, a polystyrene-butadiene, a polyester-imide, an alkali sulfonated polyester, an alkali sulfonated polyamide, an alkali sulfonated polyimide, an alkali sulfonated polystyrene-acrylate, an alkali sulfonated polystyrene-methacrylate, an alkali sulfonated polystyrene-butadiene, an alkali sulfonated polyester-imide, and combinations thereof.

* * * * *